US011572816B2

(12) United States Patent
Zhang

(10) Patent No.: US 11,572,816 B2
(45) Date of Patent: Feb. 7, 2023

(54) VEHICLE EXHAUST AND AIR-CIRCULATION SYSTEM FOR COLD START

(71) Applicant: FORD GLOBAL TECHNOLOGIES, LLC, Dearborn, MI (US)

(72) Inventor: Xiaogang Zhang, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/228,136

(22) Filed: Apr. 12, 2021

(65) Prior Publication Data

US 2022/0325647 A1 Oct. 13, 2022

(51) Int. Cl.
*F01N 3/20* (2006.01)
*F02D 41/06* (2006.01)

(52) U.S. Cl.
CPC ..... *F01N 3/2013* (2013.01); *F01N 3/2006* (2013.01); *F02D 41/064* (2013.01); *F02D 41/068* (2013.01)

(58) Field of Classification Search
CPC .... F01N 3/2006; F01N 3/2013; F02D 41/064; F02D 41/068
See application file for complete search history.

(56) References Cited

U.S. PATENT DOCUMENTS

| | | | | |
|---|---|---|---|---|
| 10,393,041 | B2 | 8/2019 | Ulrey et al. | |
| 11,105,239 | B2 * | 8/2021 | McCarrick | F01N 3/2013 |
| 2009/0133388 | A1 * | 5/2009 | Watanabe | F01N 3/2053 60/286 |
| 2015/0285161 | A1 * | 10/2015 | Ulrey | F02D 23/02 477/3 |
| 2018/0171904 | A1 * | 6/2018 | Ulrey | F01N 3/10 |
| 2019/0292964 | A1 | 9/2019 | Laube et al. | |
| 2020/0165949 | A1 * | 5/2020 | Laube | F02B 37/10 |

FOREIGN PATENT DOCUMENTS

| | | |
|---|---|---|
| CN | 202300717 U | 7/2012 |
| EP | 2342433 B1 | 7/2013 |

* cited by examiner

*Primary Examiner* — Audrey B. Walter
(74) *Attorney, Agent, or Firm* — Vincent Mastrogiacomo; Brooks Kushman P.C.

(57) ABSTRACT

A vehicle includes an engine having an intake manifold and an exhaust manifold. An exhaust system is connected to the exhaust manifold and has an aftertreatment device. The aftertreatment device has a body defining inlet and outlet cones, a heating element, and a catalyst disposed in the body between the cones. An air-circulation system has conduit extending from downstream of the catalyst to the intake manifold and an air-circulation device configured to circulate air from the outlet cone, through the conduit to the intake manifold, through the engine, to the inlet cone, and through the aftertreatment device.

19 Claims, 6 Drawing Sheets

VEHICLE EXHAUST AND AIR-CIRCULATION SYSTEM FOR COLD START

TECHNICAL FIELD

The is disclosure relates to vehicle exhaust systems and more particularly to heating of an exhaust system catalyst during engine cold start.

BACKGROUND

Vehicles may include an engine having an exhaust system. The exhaust system may include an aftertreatment device containing a catalyst. This is sometimes referred to as a catalytic converter. The catalytic converter includes a catalyst configured to convert raw exhaust gases into desired reaction products.

SUMMARY

According to one embodiment, a vehicle includes an engine having an intake manifold and an exhaust manifold. An exhaust system is connected to the exhaust manifold and has an aftertreatment device. The aftertreatment device has a body defining inlet and outlet cones, a heating element, and a catalyst disposed in the body between the cones. An air-circulation system has conduit extending from downstream of the catalyst to the intake manifold and an air-circulation device configured to circulate air from the outlet cone, through the conduit to the intake manifold, through the engine, to the inlet cone, and through the aftertreatment device.

According to another embodiment, a vehicle includes an engine having an intake manifold, an exhaust aftertreatment device having an inlet cone, an outlet cone, and a heating element, and an air-circulation system. The air-circulation system has an air-circulation device configured to circulate air from the outlet cone to the intake manifold. A controller is programmed to, in response to a request to start the engine and a temperature of the aftertreatment device being below a threshold, energize the heating element, energize the air-circulation device, and inhibit starting of the engine.

According to yet another embodiment, a method of cold starting a hybrid vehicle includes, when a catalyst of an exhaust system is less than a first threshold temperature, a driver-demanded torque is received, and an engine start is requested, opening intake and exhaust valves of an engine, energizing a heating element of the exhaust system, and circulating air across the heating element, across the catalyst, though the engine via the open valves, and back to the exhaust system; and, when the catalyst exceeds the first threshold temperature and an engine-start is requested, de-energizing the heating element and commanding starting of an engine.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
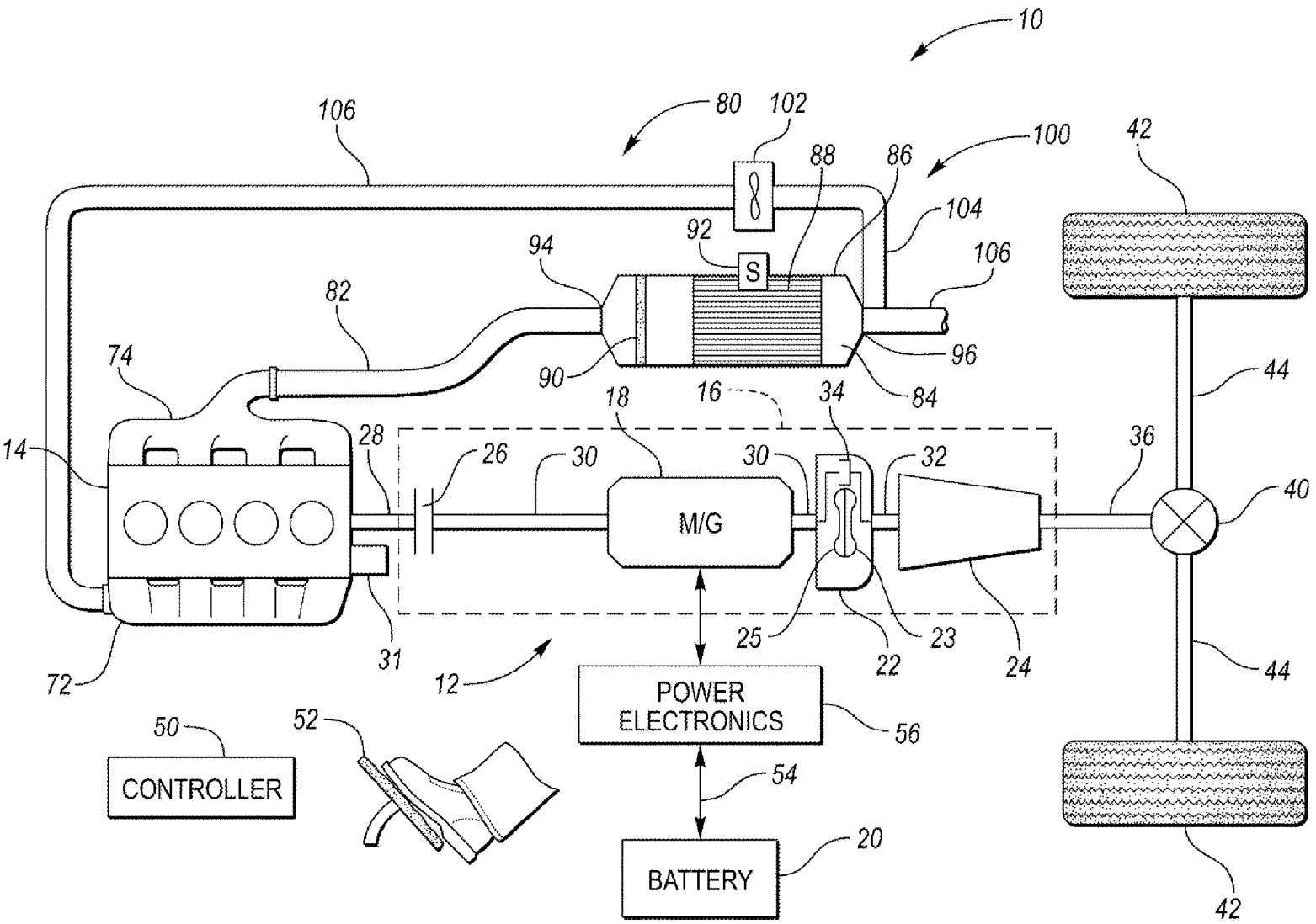
FIG. 1 is a schematic diagram of a hybrid electric vehicle according to one or more embodiments.

Referring to FIG. 1, a schematic diagram of a hybrid electric vehicle (HEV) 10 is illustrated according to an embodiment of the present disclosure. FIG. 1 illustrates representative relationships among the components. Physical placement and orientation of the components within the vehicle may vary. The HEV 10 includes a powertrain 12. The powertrain 12 includes an engine 14 that drives a transmission 16, which may be referred to as a modular hybrid transmission (MHT). As will be described in further detail below, the transmission 16 includes an electric machine such as an electric motor/generator (M/G) 18, an associated traction battery 20, a torque converter 22, and a multiple step-ratio automatic transmission or gearbox 24. The engine 14, M/G 18, torque converter 22, and the automatic transmission 16 are connected sequentially in series, as illustrated in FIG. 1. For simplicity, the M/G 18 may be referred to as a motor.

The engine 14 and the M/G 18 are both drive sources for the HEV 10 and may be referred to as actuators. The engine 14 generally represents a power source that may include an internal-combustion engine such as a gasoline or diesel engine. The engine 14 generates an engine power and corresponding engine torque that is supplied to the M/G 18 when a disconnect clutch 26 between the engine 14 and the M/G 18 is at least partially engaged. The M/G 18 may be implemented by any one of a plurality of types of electric machines. For example, M/G 18 may be a permanent magnet synchronous motor. Power electronics condition direct current (DC) power provided by the battery 20 to the requirements of the M/G 18, as will be described below. For example, power electronics may provide three-phase alternating current (AC) to the M/G 18.

When the disconnect clutch 26 is at least partially engaged, power flow from the engine 14 to the M/G 18 or from the M/G 18 to the engine 14 is possible. For example, the disconnect clutch 26 may be engaged and M/G 18 may operate as a generator to convert rotational energy provided by a crankshaft 28 and M/G shaft 30 into electrical energy to be stored in the battery 20. The disconnect clutch 26 can also be disengaged to isolate the engine 14 from the remainder of the powertrain 12 such that the M/G 18 can act as the sole drive source for the HEV 10. Shaft 30 extends through the M/G 18. The M/G 18 is continuously, drivably connected to the shaft 30, whereas the engine 14 is drivably connected to the shaft 30 only when the disconnect clutch 26 is at least partially engaged. When the disconnect clutch 26 is locked (fully engaged), the crankshaft 28 is fixed to the shaft 30.

A separate starter motor 31 can be selectively engaged with the engine 14 to rotate the engine to allow combustion to begin. Once the engine is started, the starter motor 31 can be disengaged from the engine via, for example, a clutch (not shown) between the starter motor 31 and the engine 14. In one embodiment, the starter motor 31 is a belt-integrated starter generator (BISG). In one embodiment, the engine 14 is started by the starter motor 31 while the disconnect clutch 26 is open, keeping the engine disconnected with the M/G 18. Once the engine has started and is brought up to speed with the M/G 18, the disconnect clutch 26 can couple the engine 14 to the M/G 18 to allow the engine to provide drive torque.

In another embodiment, the starter motor 31 is not provided and, instead, the engine 14 is started by the M/G 18. To do so, the disconnect clutch 26 partially engages to transfer torque from the M/G 18 to the engine 14. The M/G 18 may be required to ramp up in torque to fulfill driver demands while also starting the engine 14. The disconnect clutch 26 can then be fully engaged once the engine speed is brought up to the speed of the M/G.

The M/G 18 is connected to the torque converter 22 via shaft 30. The torque converter 22 is therefore connected to the engine 14 when the disconnect clutch 26 is at least partially engaged. The torque converter 22 includes an impeller 23 fixed to M/G shaft 30 and a turbine 25 fixed to a transmission input shaft 32. The torque converter 22 provides a hydraulic coupling between shaft 30 and transmission input shaft 32. The torque converter 22 transmits power from the impeller 23 to the turbine 25 when the impeller rotates faster than the turbine. The magnitude of the turbine torque and impeller torque generally depend upon the relative speeds. When the ratio of impeller speed to turbine speed is sufficiently high, the turbine torque is a multiple of the impeller torque. A torque converter bypass clutch 34 may also be provided that, when engaged, frictionally or mechanically couples the impeller and the turbine of the torque converter 22, permitting more efficient power transfer. The torque converter bypass clutch 34 may be operated as a launch clutch to provide smooth vehicle launch. Alternatively, or in combination, a launch clutch similar to disconnect clutch 26 may be provided between the M/G 18 and gearbox 24 for applications that do not include a torque converter 22 or a torque converter bypass clutch 34. In some applications, disconnect clutch 26 is generally referred to as an upstream clutch and the launch clutch 34 (which may be a torque converter bypass clutch) is generally referred to as a downstream clutch.

The gearbox 24 may include gear sets, such as planetary gear sets, that are selectively placed in different gear ratios by selective engagement of friction elements such as clutches and brakes to establish the desired multiple discrete or step drive ratios. For simplicity, the gear ratios may be referred to as gears, i.e., first gear, second gear, etc. The friction elements are controllable through a shift schedule that connects and disconnects certain elements of the gear sets to control the speed and torque ratios between a transmission output shaft 36 and the transmission input shaft 32. The gearbox 24 may have six speeds including first through sixth gears. In this example, sixth gear may be referred to as top gear. First gear has the lowest speed ratio and the highest torque ratio between the input shaft 32 and the output shaft 36, and top gear has the highest speed ratio and the lowest torque ratio. The gearbox 24 is automatically shifted from one ratio to another based on various vehicle and ambient operating conditions by an associated controller, such as a powertrain control unit (PCU). The gearbox 24 then provides powertrain-output torque to output shaft 36.

It should be understood that the hydraulically controlled gearbox 24 used with a torque converter 22 is but one example of a gearbox or transmission arrangement; any multiple ratio gearbox that accepts input torque(s) from an engine and/or a motor and then provides torque to an output shaft at the different ratios is acceptable for use with embodiments of the present disclosure. For example, gearbox 24 may be implemented by an automated mechanical (or manual) transmission (AMT) that includes one or more servo motors to translate/rotate shift forks along a shift rail to select a desired gear ratio. As generally understood by those of ordinary skill in the art, an AMT may be used in applications with higher torque requirements, for example.

As shown in the representative embodiment of FIG. 1, the output shaft 36 is connected to a differential 40. The differential 40 drives a pair of wheels 42 via respective axles 44 connected to the differential 40. The differential transmits approximately equal torque to each wheel 42 while permitting slight speed differences such as when the vehicle turns a corner. Different types of differentials or similar devices may be used to distribute torque from the powertrain to one or more wheels. In some applications, torque distribution may vary depending on the particular operating mode or condition, for example.

The powertrain 12 further includes one or more controllers 50 such as a powertrain control unit (PCU), an engine control module (ECM), and a motor control unit (MCU). While illustrated as one controller, the controller 50 may be part of a larger control system and may be controlled by various other controllers throughout the vehicle 10, such as a vehicle system controller (VSC). It should therefore be understood that the controller 50 and one or more other controllers can collectively be referred to as a "controller" that controls various actuators in response to signals from various sensors to control functions such as starting/stopping, operating M/G 18 to provide wheel torque or charge battery 20, select or schedule transmission shifts, etc. Controller 50 may include a microprocessor or central processing unit (CPU) in communication with various types of computer-readable storage devices or media. Computer-readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the vehicle.

The controller communicates with various vehicle sensors and actuators via an input/output (I/O) interface that may be implemented as a single integrated interface that provides various raw data or signal conditioning, processing, and/or conversion, short-circuit protection, and the like. Alternatively, one or more dedicated hardware or firmware chips may be used to condition and process particular signals before being supplied to the CPU. As generally illustrated in the representative embodiment of FIG. 1, controller 50 may communicate signals to and/or from engine 14, disconnect clutch 26, M/G 18, launch clutch 34, transmission gearbox 24, power electronics 56, and an exhaust air-circulation system 100. Although not explicitly illustrated, those of ordinary skill in the art will recognize various functions or components that may be controlled by controller 50 within each of the subsystems identified above. Representative examples of parameters, systems, and/or components that may be directly or indirectly actuated using control logic executed by the controller include fuel-injection timing, rate, and duration, throttle-valve position, spark plug ignition timing (for spark-ignition engines), intake/exhaust valve timing and duration, front-end accessory drive (FEAD) components such as an alternator, air conditioning compressor, battery charging, regenerative braking, M/G operation, clutch pressures for disconnect clutch 26, launch clutch 34, and transmission gearbox 24, and the like. Sensors communicating input through the I/O interface may be used to indicate turbocharger boost pressure, crankshaft position (PIP), engine rotational speed (RPM), wheel speeds (WS1, WS2), vehicle speed (VSS), coolant temperature (ECT), intake-manifold pressure (MAP), accelerator-pedal position (PPS), ignition-switch position (IGN), throttle-valve position (TP), air temperature (TMP), exhaust gas oxygen (EGO) or other exhaust gas component concentration or presence, intake-air flow (MAF), transmission gear, ratio, or mode, transmission-oil temperature (TOT), transmission-turbine speed (TS), torque converter bypass clutch 34 status (TCC), deceleration or shift mode (MDE), for example.

Control logic or functions performed by controller 50 may be represented by flow charts or similar diagrams in one or more figures. These figures provide representative control strategies and/or logic that may be implemented using one or more processing strategies such as event-driven, interrupt-driven, multi-tasking, multi-threading, and the like. As such, various steps or functions illustrated may be performed in the sequence illustrated, in parallel, or in some cases omitted. Although not always explicitly illustrated, one of ordinary skill in the art will recognize that one or more of the illustrated steps or functions may be repeatedly performed depending upon the particular processing strategy being used. Similarly, the order of processing is not necessarily required to achieve the features and advantages described herein, but is provided for ease of illustration and description. The control logic may be implemented primarily in software executed by a microprocessor-based vehicle, engine, and/or powertrain controller, such as controller 50. Of course, the control logic may be implemented in software, hardware, or a combination of software and hardware in one or more controllers depending upon the particular application. When implemented in software, the control logic may be provided in one or more computer-readable storage devices or media having stored data representing code or instructions executed by a computer to control the vehicle or its subsystems. The computer-readable storage devices or media may include one or more of a number of known physical devices which utilize electric, magnetic, and/or optical storage to keep executable instructions and associated calibration information, operating variables, and the like.

An accelerator pedal 52 is used by the driver of the vehicle to request a demanded torque, power, or drive command to propel the vehicle. In general, depressing and releasing the pedal 52 generates an accelerator pedal position signal that may be interpreted by the controller 50 as a demand for increased power or decreased power, respectively. This may be referred to as driver-demanded torque. Based at least upon input from the pedal, the controller 50 commands torque from the engine 14 and/or the M/G 18. The controller 50 also controls the timing of gear shifts within the gearbox 24, as well as engagement or disengagement of the disconnect clutch 26 and the torque converter bypass clutch 34. Like the disconnect clutch 26, the torque converter bypass clutch 34 can be modulated across a range between the engaged and disengaged positions. This produces a variable slip in the torque converter 22 in addition to the variable slip produced by the hydrodynamic coupling between the impeller and the turbine. Alternatively, the torque converter bypass clutch 34 may be operated as locked or open without using a modulated operating mode depending on the particular application.

To drive the vehicle with the engine 14, the disconnect clutch 26 is at least partially engaged to transfer at least a portion of the engine torque through the disconnect clutch 26 to the M/G 18, and then from the M/G 18 through the torque converter 22 and gearbox 24. When the engine 14 alone provides the torque necessary to propel the vehicle, this operation mode may be referred to as the "engine mode," "engine-only mode," or "mechanical mode."

The M/G 18 may assist the engine 14 by providing additional power to turn the shaft 30. This operation mode may be referred to as a "hybrid mode," an "engine-motor mode," or an "electric-assist mode."

To drive the vehicle with the M/G 18 as the sole power source, the power flow remains the same except the disconnect clutch 26 isolates the engine 14 from the remainder of the powertrain 12. Combustion in the engine 14 may be disabled or otherwise OFF during this time to conserve fuel. The traction battery 20 transmits stored electrical energy through wiring 54 to power electronics 56 that may include an inverter, for example. The power electronics 56 convert DC voltage from the battery 20 into AC voltage to be used by the M/G 18. The controller 50 commands the power electronics 56 to convert voltage from the battery 20 to an AC voltage provided to the M/G 18 to provide positive torque (drive torque) or negative torque (regenerative braking) to the shaft 30. This operation mode may be referred to as an "electric only mode," "EV (electric vehicle) mode," or "motor mode."

In any mode of operation, the M/G 18 may act as a motor and provide a driving force for the powertrain 12. Alternatively, the M/G 18 may act as a generator and convert kinetic energy from the powertrain 12 into electric energy to be stored in the battery 20. The M/G 18 may act as a generator while the engine 14 is providing propulsion power for the vehicle 10, for example. The M/G 18 may additionally act as a generator during times of regenerative braking in which rotational energy from spinning wheels 42 is transferred back through the gearbox 24 and is converted into electrical energy for storage in the battery 20. The M/G 18 may be referred to as providing negative torque when acting as a generator.

It should be understood that the schematic illustrated in FIG. 1 is merely exemplary and is not intended to be limiting. Other configurations are contemplated that utilize selective engagement of both an engine and a motor to transmit through the transmission. For example, the M/G 18 may be offset from the crankshaft 28, and/or the M/G 18 may be provided between the torque converter 22 and the gearbox 24. Other configurations are contemplated without deviating from the scope of the present disclosure.

Figure 2:
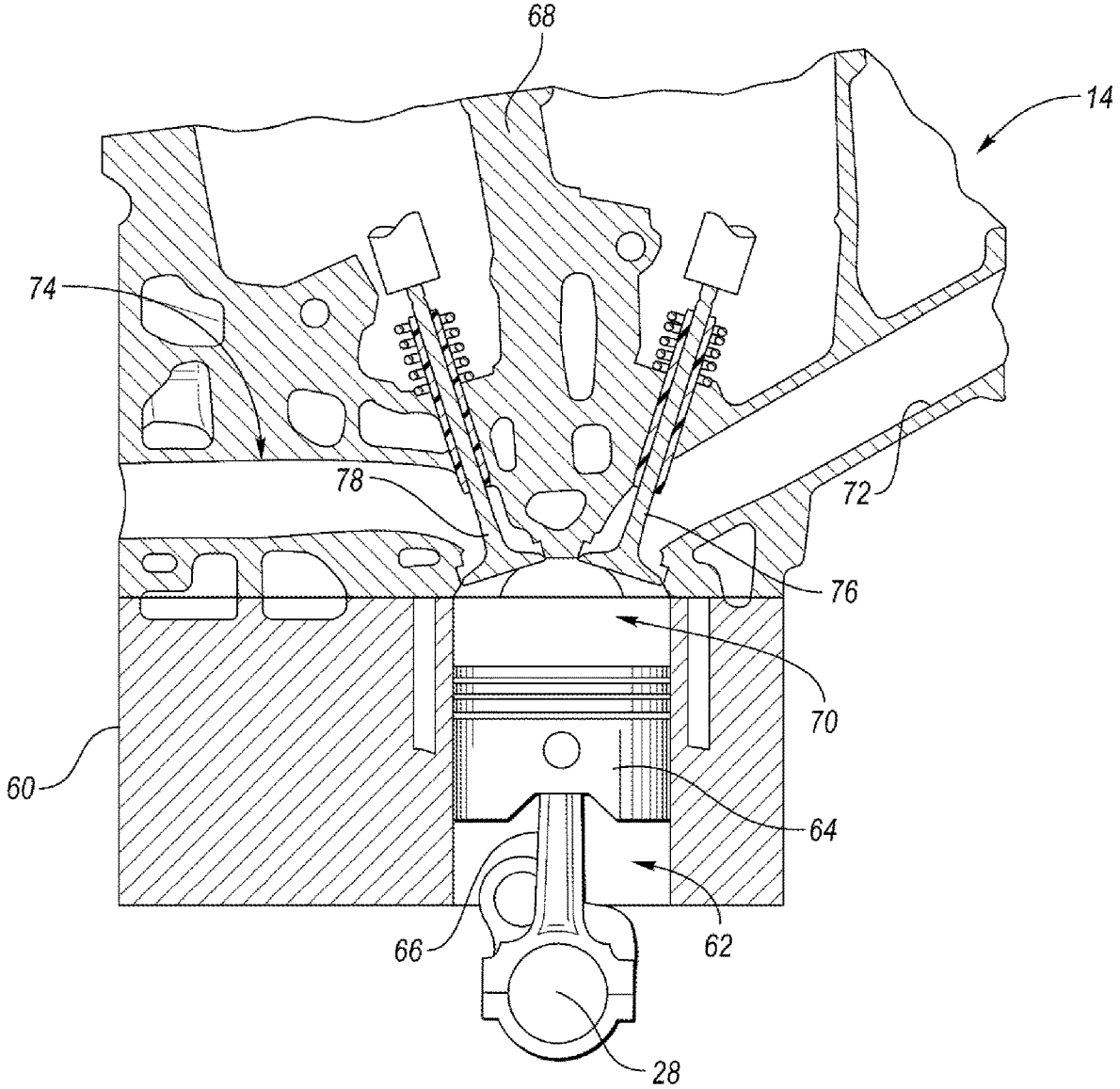
FIG. 2 is a cross-sectional view of an engine of the vehicle shown in FIG. 1.

FIG. 2 illustrates a cross-sectional view of the engine 14. The engine 14 may include a block 60 defining a plurality of cylinders 62. The illustrated block 60 is of an inline four-cylinder engine, however, this disclosure contemplates many engine configurations such as an inline six-cylinder, a V6, a V8, or any other known configuration. Pistons 64 are supported in the cylinders 62. Each of the pistons 64 includes a rod 66 that connects with the crankshaft 28. A cylinder head 68 is connected on top of the block 60. The cylinder head 68 cooperates with the block 60 to form combustion chambers 70. The combustion chambers 70 receive intake air from an intake manifold 72. Similarly, exhaust combustion gases exit the combustion chambers 70 and are transported away by an exhaust manifold 74. Intake valves 76 and exhaust valves 78 selectively connect the combustion chambers 70 in fluid communication with the intake and exhaust manifolds 72, 74. The intake and exhaust valves 76, 78 are opened and closed by one or more camshafts (not shown). In the illustrated embodiment, the engine 20 has dual-overhead camshafts with four valves per cylinder, but this is just one example. The camshafts are configured to have at least a normal operation of the valves and a cold-start operation in which some or all of the valves are held open regardless of the crankshaft position. For example, the valves and the camshafts are coupled in such a way that variable valve timing is possible as known in the art.

Referring back to FIG. 1, the vehicle includes an exhaust system 80 connected to the exhaust manifold 74. The exhaust system 80 may include one or more exhaust pipes 82 and an aftertreatment device 84. The aftertreatment device 84 may be a catalytic converter. The aftertreatment device 84 includes a housing or body 86 that may contain a catalyst 88, a heating element 90, and/or temperature sensor 92. The temperature sensor 92 is optional and the temperature of the catalyst may be inferred as known in the art. The body 86 also defines an inlet cone 94 connected to the exhaust manifold 74 via the one or more exhaust pipes 82 and an outlet cone 96 that is connected to the muffler (not shown) by one or more other exhaust pipes. In some embodiments, the aftertreatment device may attach directly to a flange of the exhaust manifold. The body 86 may have a cylindrical shape and may be centered in line with the exhaust pipes. The heating element 90 may be an electric heating element powered by the traction battery 20 or and auxiliary battery (not shown) and controlled by the controller 50. The heating element may include a coil or similar resistance element that converts electrical energy into heat through the process of Joule heating. The coil may be a spiral that fill in the diameter of the body 86. The heating element 90 may be disposed upstream of the catalyst 88, i.e., between the inlet 94 and the catalyst 88. The heating element 90 may be capable of generating very hot temperatures, such as up to 1200 degrees Celsius, so that the air may be heated in excess of 700 degrees Celsius. The temperature sensor 92 may be disposed in a location that measures the temperature of the catalyst 88. The temperature sensor 92 may be in electric communication with the controller 50 and is configured to output data to the controller indicative of a measured temperature.

The catalyst may be a two-way converter that combines oxygen with carbon monoxide and unburned hydrocarbons to produce carbon dioxide and water, or a three-way converter that also reduce oxides of nitrogen. The catalyst 88 may include a ceramic carrier matrix having a plurality of channels. A highly porous ceramic coating, sometimes referred to as a washcoat, is applied to the surface of the channels to increase the surface area. Chemical catalysts, such as precious metals platinum, palladium, and/or rhodium, are embedded in the washcoat.

The catalyst 88 is highly efficient at converting the raw exhaust gases into the desired reaction products once operating temperatures are reached. Below this temperature, and more specifically below the light-off temperature, e.g., 300 degree Celsius, the chemical reactions do not take place or are incomplete. Thus, it is advantageous to heat the catalyst quickly. It is also advantageous to quickly heat the engine to its operating temperature. Cold engines have reduced efficiency due to increased friction, fuel film on cold cylinder walls and pistons, and reduced evaporation. The emissions produced during cold start of the engine may account for as much as one third of total emissions during a drive cycle. As such, reducing the warm-up time of the engine 14 and the aftertreatment device 84 is effective for reducing emissions.

To reduce the warm-up times of the engine 14 and/or the aftertreatment device 84, an air-circulation system 100 is employed in conjunction with the heating element 90. The air-circulation system 100 is configured to circulate air exiting the aftertreatment device, e.g., downstream of the outlet 96, to the intake manifold 72. The air-circulation system 100 may include one or more first conduit 104 having an upstream end connected to an exhaust pipe 106, such as by a tee fitting, or connected to the aftertreatment device, and a downstream end connected to a suction side of an air-circulation device 102. One or more conduit 106 may connect the high-pressure side of the air-circulation device 102 to the intake manifold 72. The air-circulation device 102 may be any device configured to circulate air. Examples include a fan, a blower, an air pump, and the like. The air-circulation device 102 may include an associated electric motor that is powered by the traction battery 20 or by the auxiliary battery. The motor powers rotatable fan blades, vanes, or the like to circulate air. The energization state and operating parameters, e.g., speed, of the air-circulation device 102 may be controlled by the controller 50 as will be described in more detail below.

The engine 14 and the exhaust system 80 are heated by circulating air across the energized heating element 90 and then flowing the heated air through the catalyst 88 and the engine 14. The catalyst is heated first, then the heated air is circulated to the intake manifold 72, through the engine 14, and back to the inlet 94 to repeat the loop. All of the intake and exhaust valves 76, 78 of the engine 14 may be open so that the heated air can be circulated from the intake manifold 72, through the combustion chambers 70, and then out of the exhaust manifold 74. The engine 14 may be OFF during this warm-up routine. In the case of a hybrid, the traction motor, e.g., M/G 18, can be used to propel the vehicle during the warm-up routine. That is, the vehicle may be in the electric only mode as described above.

Figure 3:
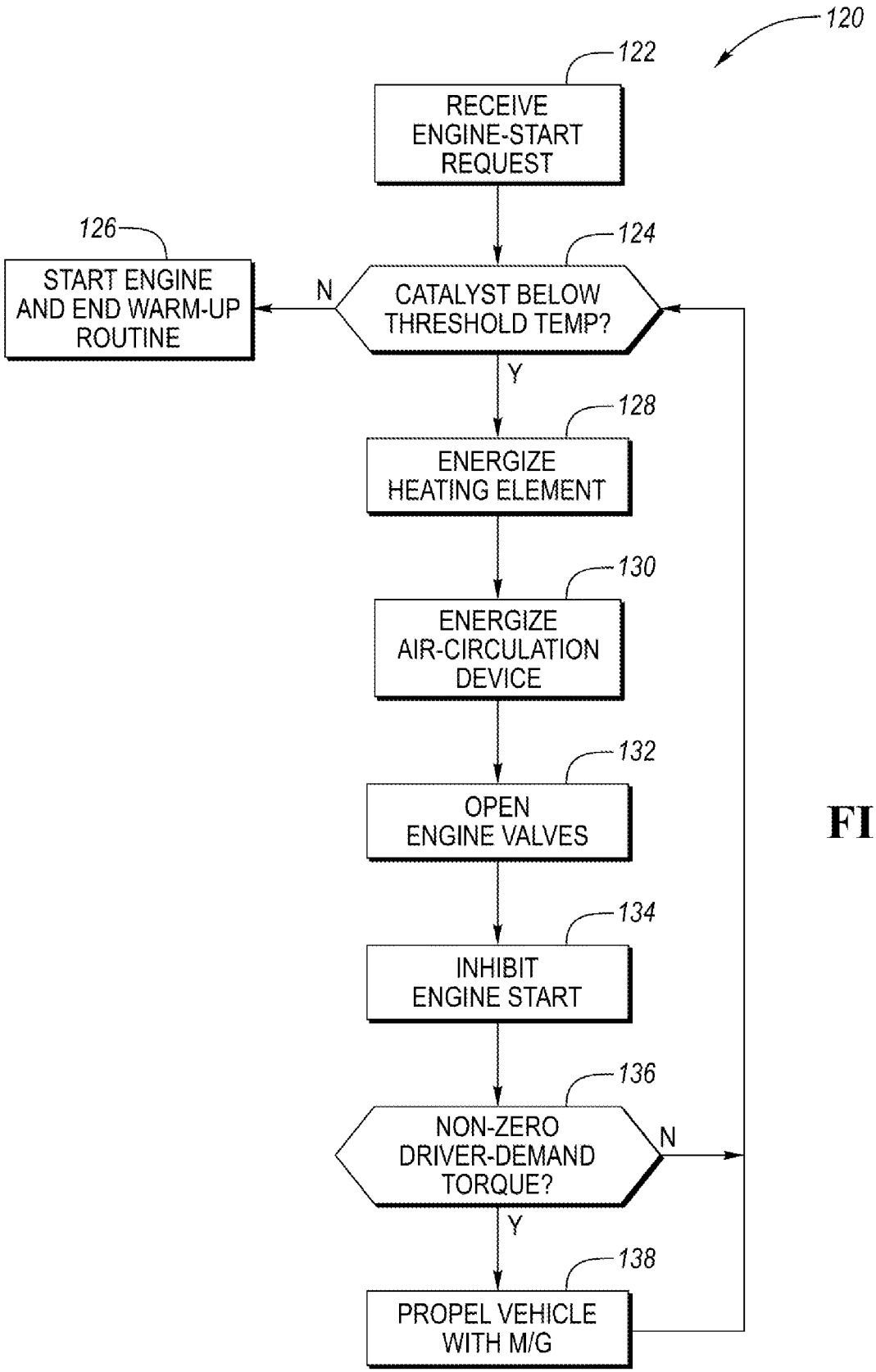
FIG. 3 is a flow chart of an example algorithm for operating the vehicle of FIG. 1 during an engine cold start.

FIG. 3 illustrates a flowchart 120 of an example algorithm for performing a warm-up routine during cold starting of the engine and exhaust system. Controls 120 may begin at operation 122 with a request to start the engine. Alternatively, the warm-up routine may be initiated at key-on or during a preconditioning mode in which the vehicle is prepared for departure. As discussed above, the engine may be requested to start for a variety of reasons such as low battery state of charge, high driver-demanded torque, and others. At operation 124, the controller determines if the catalyst is below a threshold temperature. The catalyst temperature may be determined based on data provided by the temperature sensor 92 or inferred. The threshold temperature may be the light-off temperature or may be a higher or lower temperature. An example threshold temperature may be between 200 degrees and 350 degrees Celsius depending upon the catalyst used. If the catalyst temperature is above the threshold, the engine may be started at operation 126.

Control passes operation 128 if the catalyst is below the threshold temperature. In response to the catalyst being less than the threshold temperature at operation 124, the controller energizes the heating element at operation 128 and energizes the air-circulation device at operation 130. At operation 132, the controller opens the engine valves open. The controller may command all of the engine valves open or may only command select ones of the valves. Once the engine valves are open, a closed loop is formed allowing air to be circulated across the heating element, through the catalyst, into the air-circulation loop, to the intake manifold, through the engine, and back to the exhaust system for recirculation. The circulation of heated air warms the catalyst and the engine.

The engine is inhibited from starting during the warm-up routine as shown at operation 134. The engine may be disconnected from the M/G 18 by opening the disconnect clutch. This allows the vehicle to be propelled in electric-only mode without rotating the crankshaft of the engine. At operation 136, the controller determines if a non-zero driver-demanded torque is being requested, i.e., is the accelerator pedal actuated or is the vehicle demanding wheel torque? If no, the vehicle remains parked and control loops back to operation 124 to determine if the catalyst has been heated to the threshold temperature. If yes, the engine is then started and the warm-up routine ends, i.e., the heating element and the air-circulation system may be de-energized. If a non-zero driver-demanded torque is present during the warm-up routine, control passes operation 138 and an electric-only mode request is issued. The request may be sent to other control logic associated with propelling the vehicle. That is, the vehicle is only propelled with the M/G to allow the warm-up routine to continue. While not illustrated, the vehicle control logic may exit the warm-up mode and start the engine regardless of catalyst temperature if it is necessary for the engine to start, e.g., low battery state of charge, insufficient electric only torque, or the like. Otherwise, the air-circulation system will circulate heated air through the engine and the exhaust system until the catalyst temperature reaches the threshold.

Figure 4:
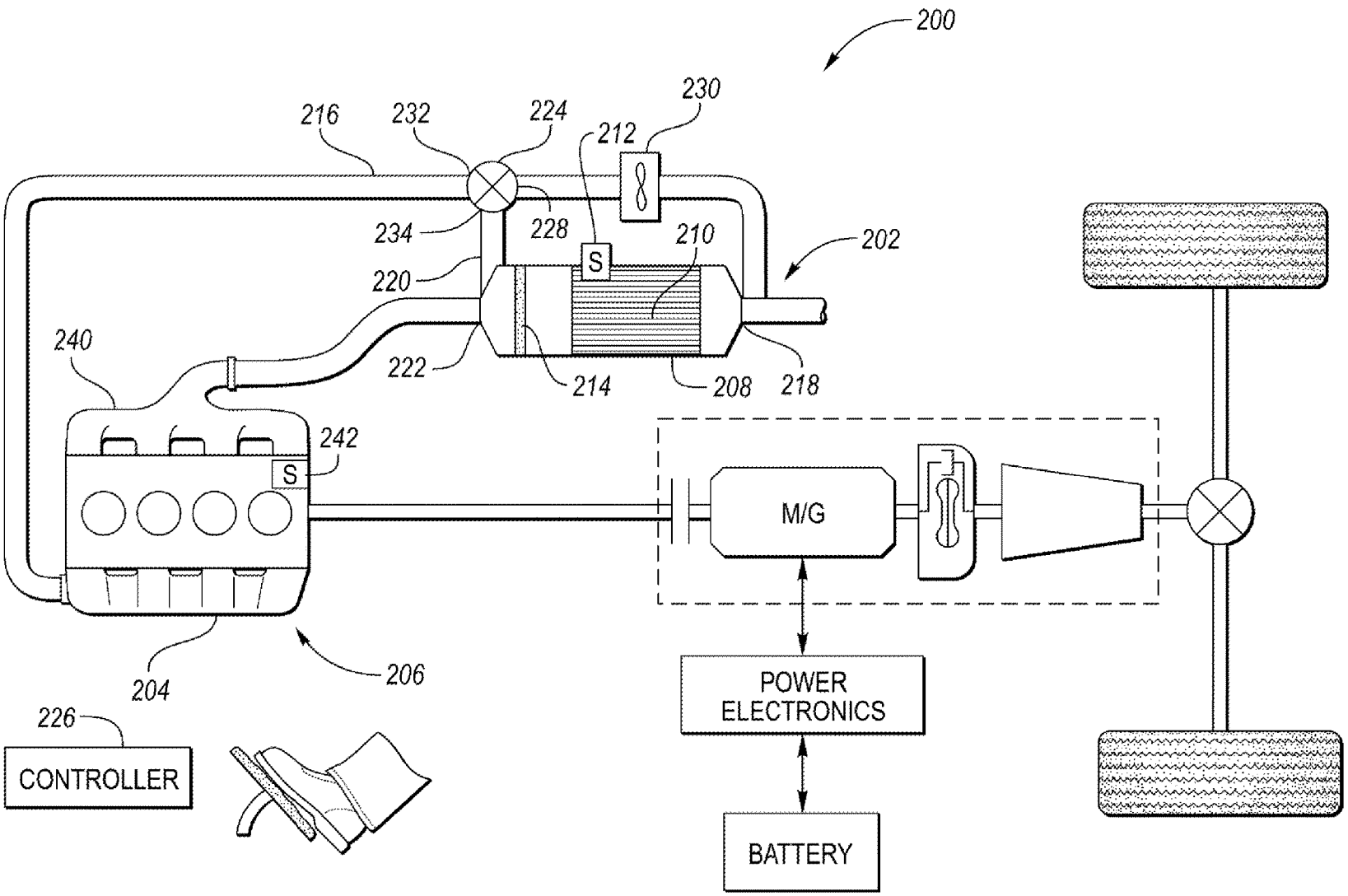
FIG. 4 is a schematic diagram of another hybrid electric vehicle according to another embodiment.

FIG. 4 illustrates another air-circulation system 200 configured to circulate air from the exhaust system 202 to the intake manifold 204 of an engine 206. The air-circulation system 200 may be used on a hybrid vehicle such as the vehicle 10 described above or other configuration. The exhaust system 202 is similar to the exhaust system described above and includes an aftertreatment device 208 having a catalyst 210, a temperature sensor 212 (optional), and a heating element 214. The air-circulation system 200 includes a main loop 216 that connects the outlet 218 of the aftertreatment device 208 to the intake manifold 204 and a bypass loop 220 that skips the engine and instead routes the exhaust back to inlet 222 of the aftertreatment device 208.

A valve 224 controls the flow of air to the engine 206 or to the inlet 222. The valve 224 may be a three-way valve. For example, the valve may be a butterfly valve, a barrier valve, a poppet valve, one or more blend doors, or the like. The valve 224 may be electronically controlled and in communication with a controller 226. The controller 226 may be similar to the above-described controller 50 albeit with programming specific to the air-circulation system 200 as will be described below. The valve 224 may include an inlet 228 that receives air from the high-pressure side of the air-circulation device 230. The valve 224 also includes a first outlet 232 that connects to the intake manifold and a second outlet 234 that connects to the bypass loop 220. An actuator of the valve 224 is configured to selectively connect the inlet 228 to the first outlet 232 and to connect the inlet 228 to the second outlet 234. That is, the valve 224 includes a first position in which the inlet 228 is connected in fluid communication with the outlet 232 so that air is routed to the intake manifold, and the valve includes a second position in which the inlet 228 is connected in fluid communication with the outlet 234 so that air is routed to the inlet 222 of the aftertreatment device 208. The addition of the valve 224 and the bypass loop 220 allows the air-circulation system 200 to heat both the catalyst 210 and the engine 206 when the valve 224 is in the first position and heat only the catalyst 210 when the valve 224 is in the second position.

When the valve is in the first position, air is circulated across the heating element 214 and subsequently heats the catalyst 210. The air is then drawn through the air-circulation device 230 and routed to the valve 224. Within the valve, the air is directed from the inlet 228 to the first outlet 232. The main loop 216 carries the air to the intake 204. The air then circulates through the engine 206 as described above with the valves in the open positions. The air then exits the exhaust manifold 240 and is routed back to the inlet 222 of the aftertreatment device 208 for recirculation. In this valve position, heated air warms both the engine 206 and the catalyst 210.

When the valve 224 is in the second position, air is circulated across the heating element 214 and subsequently heats the catalyst 210. The air is then drawn through the air-circulation device 230 and routed to the valve 224. Within the valve, the air is directed from the inlet 228 to the second outlet 234. The bypass loop 220 is connected to the second outlet 234 and routes the air around the engine back to the inlet 222. In this valve position, the heated air only circulates to the aftertreatment device to heat the catalyst 210.

The controller 226 is programmed to actuate the valve and control the air-circulation system 200 to only heat the catalyst 210 when first conditions are present and to heat both the engine 206 and the catalyst 210 when other conditions are present.

Figure 5A:
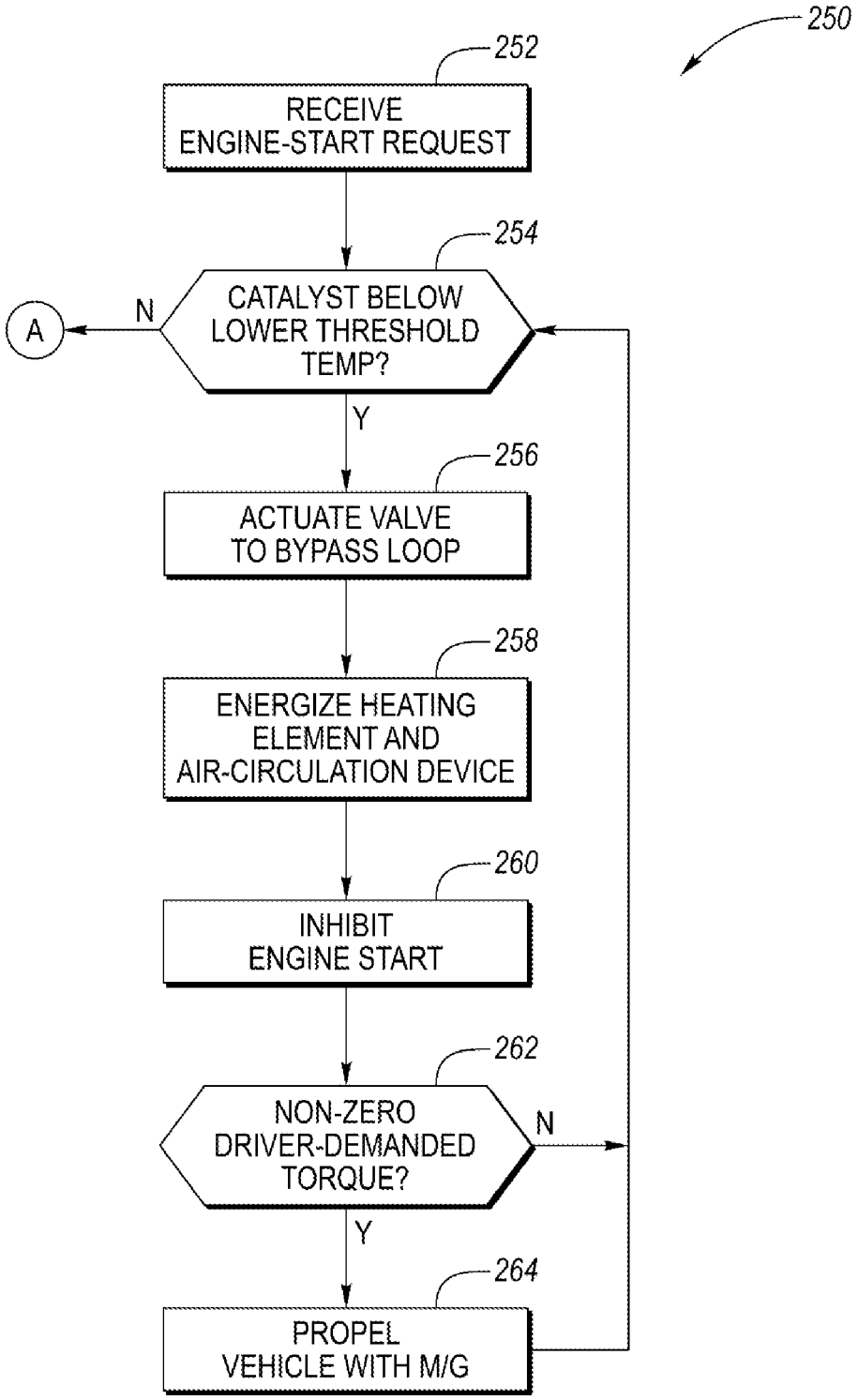
FIGS. 5A and 5B show a flow chart of an example algorithm for operating the vehicle of FIG. 4 during an engine cold start.
Figure 5B:
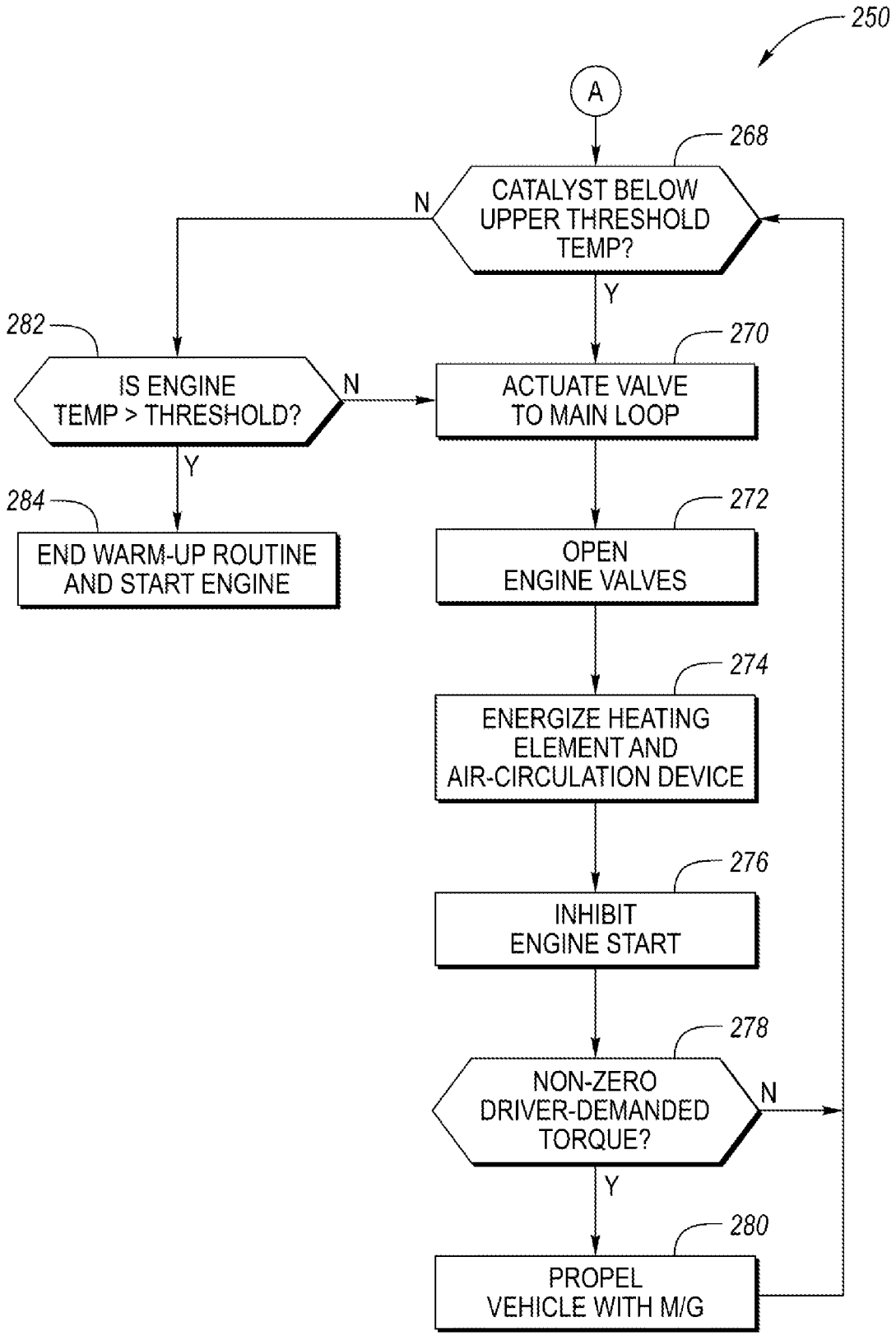

FIGS. 5A and 5B illustrate a flowchart 250 of an example algorithm for performing a warm-up routine during cold starting of the engine and exhaust system. The flowchart 250 may be executed by the controller 226 to control an air-circulation system having a valve such as that disclosed in the embodiment of FIG. 4 and related text.

Controls 250 may begin at operation 252 with a request to start the engine. Alternatively, the warm-up routine may be initiated at key-on or during a preconditioning mode in which the vehicle is prepared for departure. As discussed above, the engine may be requested to start for a variety of reasons such as low battery state of charge, high driver-demanded torque, and others. At operation 254, the controller determines if the catalyst is below a lower threshold temperature (first threshold temperature). The lower threshold temperature triggers the air-circulation system to actuate the valve between the first and second positions. When the catalyst is below the lower threshold, the valve is actuated to the bypass position to heat only the catalyst, and when the catalyst is above the lower threshold, the valve is actuated to the other position to heat both the engine and the catalyst. The lower threshold temperature may be below the light-off temperature. An example lower threshold temperature may be between 200 degrees and 280 degrees Celsius depending upon the catalyst used.

If the catalyst is below the lower threshold temperature, control passes to operation 256 and the controller commands the valve to the second position in which air is circulated from the outlet of the aftertreatment device and back to the inlet via the bypass loop, i.e., only the catalyst heated. At operation 258, the controller energizes the heating element and energizes the air-circulation device.

The engine is inhibited from starting during the warm-up routine as shown at operation 260. At operation 262, the controller determines if a non-zero driver-demanded torque is being requested, i.e., is the accelerator pedal actuated or is the vehicle demanding wheel torque? If no, the control loops back to operation 254 to determine if the catalyst has been heated to the lower threshold temperature. If a non-zero driver-demanded torque is present during the warm-up routine, control passes to operation 264 and an electric-only mode request is issued. The request may be sent to other control logic associated with propelling the vehicle. That is, the vehicle is only propelled with the M/G to allow the warm-up routine to continue. While not illustrated, the vehicle control logic may exit the warm-up mode and start the engine regardless of catalyst temperature if it is necessary for the engine to start.

If the catalyst exceeds the lower temperature threshold at operation 254, control passes to operation 268 and the controller determines if the catalyst is below an upper threshold temperature. The upper threshold temperature may be at or near the light-off temperature, e.g., 300 degrees Celsius depending upon the catalyst used. If yes at operation 268, control passes to operation 270 and the controller commands the valve to the first position in which the air-circulation system circulates air from the outlet of the aftertreatment device to the engine intake via the main loop. At operation 272, the exhaust and intake valves of the engine are opened to allow the circulation of air from the intake manifold, through the combustion chambers, and to the exhaust manifold. The heating element and the air-circulation device are energized at operation 274. Operations 276, 278, and 280 are the same as operations 260-264 and will not be discussed again for brevity.

Once the catalyst exceeds the upper threshold, control passes to operation 282 and the controller determines if the engine temperature is greater than a threshold. For example, the engine may include a temperature sensor 242 that is in electric communication with the controller 226. The engine temperature threshold may be between 100 degrees and 150 degrees Celsius. If yes at operation 282, control passes to operation 284 where the warm-up routine ends and the engine is started. If the engine temperature is less than the threshold, control passes to operation 270 and the warm-up routine continues until the engine is heated above the threshold. The engine temperature control boxes are optional, and, in an alternative embodiment(s), the engine is started once the catalyst temperature exceeds the upper threshold regards of engine temperature.

While various aspects of this invention have been described in conjunction with the hybrid vehicle of FIG. 1 as the representative embodiment, this invention is not limited thereto. In other embodiments, the vehicle may have a power-split hybrid architecture, such as that described in Applicants U.S. Pat. No. 9,919,608 issued Mar. 20, 2018, the contents of which are incorporated by reference herein. Alternatively, the vehicle may have a conventional powertrain that relies solely on an internal-combustion engine for power.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A vehicle comprising:

an engine including an intake manifold and an exhaust manifold;

an exhaust system connected to the exhaust manifold and including an aftertreatment device, the aftertreatment device having a body defining inlet and outlet cones, a heating element, and a catalyst disposed in the body between the cones; and an air-circulation system including conduit extending from downstream of the catalyst to the intake manifold and an air-circulation device configured to circulate air from the outlet cone, through the conduit, wherein the air-circulation system further includes a bypass conduit connected between the conduit and the inlet cone.

2. The vehicle of claim 1, wherein the conduit is in fluid communication with the outlet cone.

3. The vehicle of claim 1 further comprising an electric machine operably coupled to the engine.

4. The vehicle of claim 1, wherein the air-circulation device includes an electric fan.

5. The vehicle of claim 1 further comprising a controller programmed to:

in response to a request to start the engine and a temperature of the catalyst being below a threshold, open all intake and exhaust valves of the engine, energize the heating element, energize the air-circulation device, and inhibit starting of the engine, and in response to the request to start the engine and the temperature of the catalyst exceeding the threshold, de-energize the heating element and the air-circulation device, and command starting of the engine.

6. The vehicle of claim 1, wherein the engine further includes intake and exhaust valves, and further comprising:

a temperature sensor disposed in the body downstream of the heating element and configured to output temperature data indicative of a measured temperature; and a controller programmed to:

in response to a request to start the engine and the measured temperature being below a threshold, energize the heating element, energize the air-circulation device, open all of the intake and exhaust valves so that the air-circulation system circulates the air through the engine, and inhibit starting of the engine, and in response to the measured temperature exceeding the threshold and the request to start the engine, de-energize the heating element and the air-circulation device, and command starting of the engine.

7. The vehicle of claim 1, wherein the air-circulation system further includes a valve configured to circulate the air to the engine when in a first position and to the bypass conduit when in a second position.

8. The vehicle of claim 7 further comprising a controller programmed to:

in response to a request to start the engine and a temperature of the catalyst being below a first threshold, energize the heating element, energize the air-circulation device, actuate the valve to the second position, and inhibit starting of the engine, in response to the temperature of the catalyst exceeding the first threshold and being less than a second threshold, open all intake and exhaust valves of the engine, actuate the valve to the first position, and inhibit starting of the engine, and in response to the temperature of the catalyst exceeding the first and second thresholds and the request to start the engine, de-energize the heating element and the air-circulation device and command starting of the engine.

9. The vehicle of claim 7 further comprising a controller programmed to:

in response to a request to start the engine and a temperature of the catalyst being below a first threshold, energize the heating element, energize the air-circulation device, actuate the valve to the second position, and inhibit starting of the engine, in response to the temperature of the catalyst exceeding the first threshold and being less than a second threshold, open all intake and exhaust valves of the engine, actuate the valve to the first position, and inhibit starting of the engine, and in response to the temperature of the catalyst exceeding the first and second thresholds and a temperature of the engine exceeding a third threshold, de-energize the heating element and the air-circulation device and command starting of the engine.

10. The vehicle of claim 7 further comprising a controller programmed to:

in response to a request to start the engine and a temperature of the catalyst being below a first threshold, energize the heating element, energize the air-circulation device, actuate the valve to the second position, and inhibit starting of the engine, in response to the temperature of the catalyst exceeding the first threshold and a temperature of the engine being less than a second threshold, open all intake and exhaust valves of the engine, actuate the valve to the first position, and inhibit starting of the engine, and in response to the temperature of the catalyst exceeding a third threshold, the temperature of the engine exceeding the second threshold, and the request to start the engine, de-energize the heating element and the air-circulation device and command starting of the engine.

11. The vehicle of claim 10 further comprising an electric machine, wherein the controller is further programmed to, in response to the engine being inhibited from starting and a driver-demanded torque being received, command the driver-demanded torque to the electric machine.

12. A vehicle comprising:

an engine including an intake manifold;

an exhaust aftertreatment device having an inlet cone, an outlet cone, and a heating element;

an air-circulation system including an air-circulation device configured to circulate air from the outlet cone to the intake manifold, wherein the air-circulation system further includes a bypass conduit connected between the conduit and the inlet cone; and a controller programmed to:

in response to a request to start the engine and a temperature of the aftertreatment device being below a threshold, energize the heating element, energize the air-circulation device, and inhibit starting of the engine, and in response to the temperature of the aftertreatment device exceeding the threshold and the request to start the engine, de-energize the heating element and the air-circulation device, and command starting of the engine.

13. The vehicle of claim 12, wherein the air-circulation device is a fan.

14. A vehicle comprising:

an engine including an intake manifold;

an exhaust aftertreatment device having an inlet cone, an outlet cone, and a heating element;

an air-circulation system including an air-circulation device configured to circulate air from the outlet cone to the intake manifold, wherein the air-circulation system further includes a valve having a first inlet in fluid communication with the air-circulation device, a first outlet in fluid communication with the intake manifold, and a second outlet in fluid communication with the inlet cone, and wherein the valve is configured to connect the outlet cone and the intake manifold in fluid communication when in a first position and to connect the outlet cone and the inlet cone in fluid communication when in a second position; and a controller programmed to, in response to a request to start the engine and a temperature of the aftertreatment device being below a threshold, energize the heating element, energize the air-circulation device, and inhibit starting of the engine.

15. The vehicle of claim 14, wherein the controller is further programmed to, in response to the request to start the engine and the temperature of the aftertreatment device being below the threshold, open all intake and exhaust valves of the engine.

16. The vehicle of claim 14, wherein the air-circulation device is a fan.

17. The vehicle of claim 14, wherein the controller is further programmed to, in response to the temperature of the aftertreatment device exceeding the threshold and the request to start the engine, de-energize the heating element and the air-circulation device, and command starting of the engine.

18. The vehicle of claim 14, wherein the controller is further programmed to, in response to the temperature of the aftertreatment device being less the threshold, actuate the valve to the second position.

19. The vehicle of claim 18, wherein the controller is further programmed to, in response to the temperature of the aftertreatment device exceeding the threshold and being less than a second threshold, actuate the valve to the first position.

* * * * *